United States Patent [19]

Gach

[11] Patent Number: 4,719,740

[45] Date of Patent: Jan. 19, 1988

[54] TAMPER INDICATING HERMETIC SEAL

[75] Inventor: Peter P. Gach, Evansville, Ind.

[73] Assignee: Sunbeam Plastics Corporation, Evansville, Ind.

[21] Appl. No.: 922,126

[22] Filed: Oct. 22, 1986

[51] Int. Cl.[4] ..... B65B 61/02; B65B 51/22; B67B 3/20

[52] U.S. Cl. ..... 53/421; 53/478; 53/487; 156/69

[58] Field of Search ..... 53/412, 420, 421, 478, 53/487; 156/69, 252, 253, 256, 257, 262, 295

[56] References Cited

U.S. PATENT DOCUMENTS

| | | | |
|---|---|---|---|
| 3,460,310 | 8/1969 | Adock et al. | 53/478 |
| 3,486,959 | 12/1969 | Podesta et al. | 156/262 |
| 3,494,093 | 2/1970 | Downs et al. | 53/420 |
| 3,583,125 | 6/1971 | Vermeulen | 53/478 X |
| 3,767,076 | 10/1973 | Kennedy | 156/69 X |
| 3,815,314 | 6/1974 | Pollock et al. | 53/420 |
| 3,826,059 | 7/1974 | Novitch | 53/412 X |
| 3,874,143 | 4/1975 | Braber | 53/412 |
| 4,228,633 | 10/1980 | Corbic | 53/412 |

*Primary Examiner*—Horace M. Culver

*Attorney, Agent, or Firm*—Irvin L. Groh; Alfred L. Patmore, Jr.

[57] ABSTRACT

A method of constructing a closure and applying it to a container to provide a hermetically sealed, tamper-indicating package which can be easily opened without danger of contaminating the container contents by fragmentation of the sealing element. The sealing element is formed as a laminated liner disk haivng an inner foil layer and an outer tough thermoplastic layer. A heat sealing layer allows the liner disk to be hermetically sealed to the container by induction heating after the closure is attached to the container. A frangible opening line is created by melting through the thermoplastic layer and heat sealing layer to the metal foil layer.

16 Claims, 11 Drawing Figures

TAMPER INDICATING HERMETIC SEAL

This invention relates to a tamper indicating closure providing a hermetic seal, and, more particularly to the method of manufacturing such a closure and to its assembly to a container.

In the development of tamper indicating, hermetically sealed packages from which a liquid product is dispensed, sealing a membrane to the container neck opening has become a common practice as the membrane serves the dual purpose of providing a hermetic seal and providing tamper indication by evidence of its removal or penetration.

Where the dispensing is to take place through a special passage in the closure so that closure remains attached to the container, a recent development provides for fusion of the closure to the container at the same time that a membrance is hermetically sealed between the container and the closure over the dispensing orifice. This is shown in U.S. Pat. No. 4,537,318 to Montgomery in which a thin metallic foil is coated on both sides or a laminate is produced with a central metallic foil and materials on both sides which can be heat fused to the closure and the container. This laminate, in the form of a disc, is inserted into the closure cap so that when the cap is applied to the filled container, the foil can be heated by induction heating apparatus to fuse the coatings on both sides of the foil to the cap and container providing the tamper indicating hermetic seal over the dispensing orifice. Entrance to the container is obtained by piercing the thin foil with little or no regard to the possibility of a portion of the foil mixing with the product. This presents no problems in the packaging of household products such as lotions and the like. Also in this type of closure, the dispensing orifice is thereafter closed by a plug member depending from a hinged lid forming part of the closure.

In packaging other products, such as motor oil, it is desirable to maintain the full neck opening for dispensing the product. In this case, a aluminum foil is often glued or otherwise sealed to the lip of the container neck. For resealing purposes, a resilient material such as pulp board is inserted in the closure cap so that once the foil is torn away, the container may be resealed. Applying such a seal by the use of heat sealable layer on the metal foil and applying induction heating is shown in U.S. Pat. No. 3,460,310 to Adcok, et al. Other laminate structures, and the method of applying them to the container are shown in U.S. Pat. No. 3,815,314 to Pollock, et al.

One of the difficulties encountered with the use of the latter type of metallic foil hermetic seals has been the danger of introducing a portion of the foil seal into the container when the user is gaining access. In the case of motor oil, motor damage could result from such foil contamination. Attempts to solve this problem by laminating a tough thermoplastic film to the metal foil results in a seal which is difficult to remove and becomes vexatious to the user.

It is, therefore, a principal object of this invention to provide a method of assembling a closure and applying it to a container to produce a hermetic seal which can be easily opened without the danger of introducing a portion of the foil into the product in the container.

Other objectives and advantages of the invention have been realized in the assembling of a closure with a sealable liner which when applied to the container produces a hermetically sealed package and which is easily opened and provides tamper indication means to the perspective consumer. The laminated liner in its simplest form includes a layer of metal foil adhesively bonded to a tough thermoplastic film and a sealing layer.

The method of producing and assembling the closure includes the step of moving a continuous web of this laminate and the step of cutting a liner disk from the web to fit into the closure and sealingly engage the container. Another step is to insert the liner disk into the closure. In a melting step, a heated tool or die is brought into contact with the laminated liner so as to melt through the sealing layer and the thermoplastic film to the metal foil forming a frangible opening line along which only the foil remains. The closure is applied to the container, and the bonding is completed. In a preferred form, a heat sealable layer is utilized and the bonding step includes inductively heating the foil to fuse the sealing layer to the container.

In one embodiment, the laminated liner includes consecutive layers of a resilient material such as paper board, a wax providing a releasable bond, a metal foil, a tough thermoplastic film, and a sealing layer. The melting step in this case is performed from one side of the liner disk melting through the thermoplastic film and heat sealing layer to the foil. In the completed package, access to the contents of the container is obtained by removal of the closure cap which fractures the wax coating leaving the resilient pulp board in the cap. The appearance of a nonfractured seal provides evidence that there has been no tampering or prior attempt at opening. The hermetic seal is easily opened by finger pressure along the frangible opening line additionally pulling a portion of the foil seal away from the container lip.

In another embodiment the laminated liner is formed with a thermoplastic film which is bonded to one side of the foil and the heat sealing layer is applied to the other side of the foil. In this case, the melting step includes melting through the sealing layer on one side of the foil and melting through the thermoplastic film on the other side of the foil to form the frangible opening line.

In some instances, it may be desirable to apply the strengthening tough thermoplastic film to both sides of the foil with the heat sealing coating being applied to the film on one side for bonding to the container. This also requires melting through the heat sealing coating and the thermoplastic film on both sides of the foil by bringing a heated tool in contact with the liner from both sides.

A melting step can be performed at the laminated liner is being moved by bringing a heated tool into contact with one or both sides of the web. In the case of a single straight frangible opening line, a simple heated straight line tool can be utilized.

Even though the sealing layer is melted away along the opening line 30 across the entire diameter, the sealing material will completely seal the perimeter of the container top to provide a completely hermetic seal. In some instances, it may be desirable to form the frangible opening line as a pair of crossed lines perpendicular to each other or a plurality of intersecting lines. Also it may be desirable to form a flap by a circular line subtending somewhat more than 270 degrees. In these cases, the melting step can still be performed while the web is moving by bringing a rotating die holder into contact with one or both sides of the laminate liner web.

In other continuous packaging lines, it is desirable to cut the liner disk from the web prior to the melting step. In this case the liner disk is inserted into the closure, and the melting step is performed by introducing a heated die into the closure into contact with the sealing layer. In some instances, a compound die can be utilized to perform the cutting, inserting and melting step sequentially with a compound tool. Other variations in the liner composition and method of assembly will become apparent from the detailed description.

The presently preferred embodiments of the invention are illustrated in the accompanying drawing in which.

Figure 1:
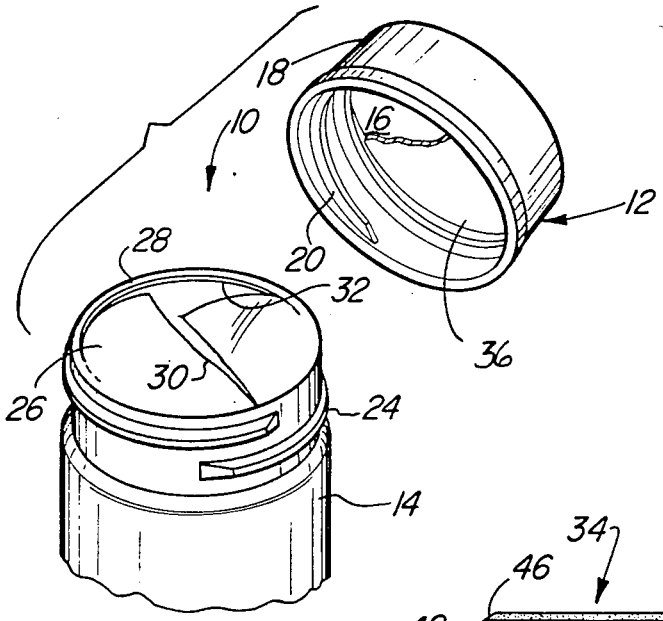
FIG. 1 is a perspective exploded view showing the closure cap removed from the container neck and the hermetic seal broken by separation along the frangible opening line and partial tearing of the foil from the lip of the container neck.

Referring to FIG. 1, the dispensable product package 10 of this invention is shown with its closure 12 in the form a threaded cap in a position to be screwed onto container neck 14. Cap 12 is shown as having a flat top 16 and a cylindrical skirt 18 with internal threads 20. A resilient liner layer 26 is shown as remaining in the cap 12. The container neck 14 as complementary threads 24, and is shown with sealing disk 26 attached to lip 28. The sealing disk has been partially pushed in for product dispensing along frangible opening line 30 by finger pressure which also has torn a portion of the liner disk 26 from the lip at 32.

Figure 2:
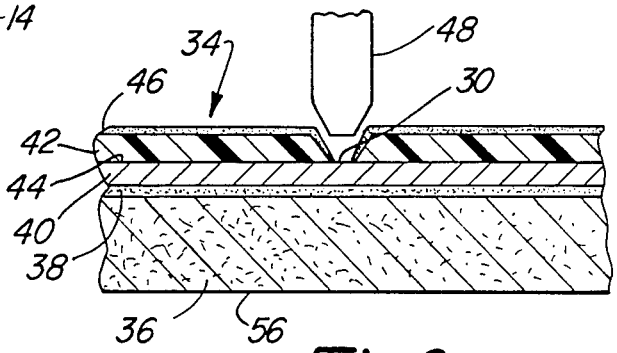
FIG. 2 is cross-section of the laminated liner material showing the application of a heated tool or die to one surface of the laminate to form a frangible opening line.

Liner disk 26 in its original form was cut from a moving web 34 of laminated liner material. As shown in FIG. 2, this material includes a resilient base such as pulp or paper board 36 which may have a thickness of between 0.005"–0.040". Next is a coating or layer of a wax which serves as a releasable bonding material to the next layer 40 which is a metallic foil. This foil is typically of aluminum with a thickness between 0.001"–0.003". Bonded to the other face of foil layer 40 is a layer 42 of tough thermoplastic material held to the foil by a adhesive binding material shown at 44. Film 42 may be of a polyester material having a thickness of 0.0005"–0.002". the adhesive 44 for bonding the polyester film 42 to the foil layer 40 can be a polyurethane material. The final layer 46 is sealing layer, and preferably it is a heat sealing material such as a layer of polyethylene having a thickness of 0.001"–0.002". Frangible opening line 30 is formed by heated tool 48 which melts through the heat sealing layer 46 and the polyester film 42 to expose the foil layer 44 along this flangible opening line.

Figure 8:
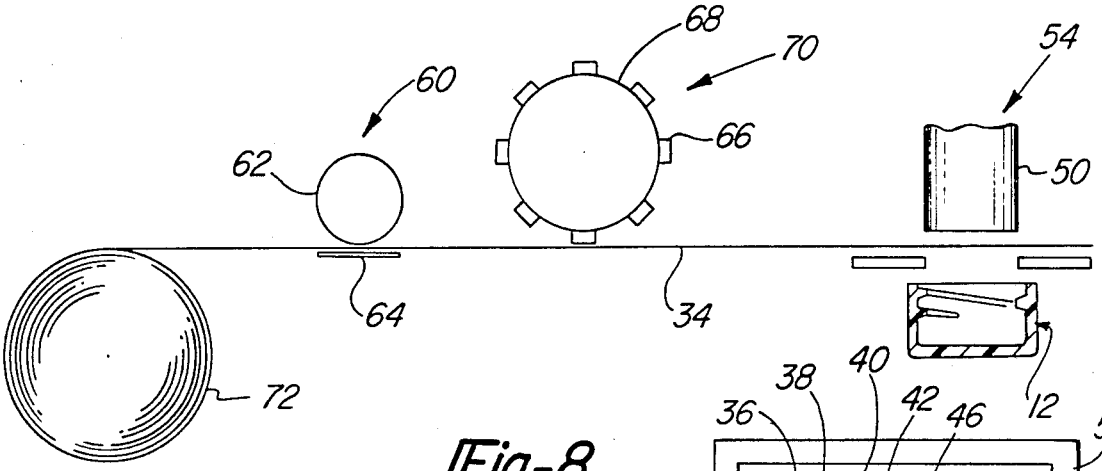
FIG. 8 is a schematic view in elevation showing the laminated liner web being moved through alternatively used frangible line melting stations and a disk shearing and closure inserting stations.
Figure 11:
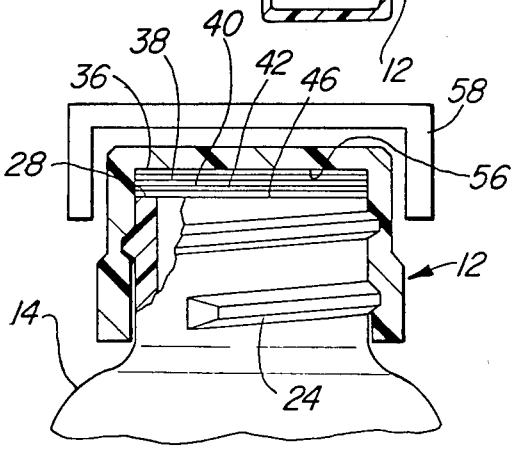
FIG. 11 is an elevational view in cross-section of the closure applied to the container showing the laminated liner disk and showing an induction heater schemmatically.
Figure 9:
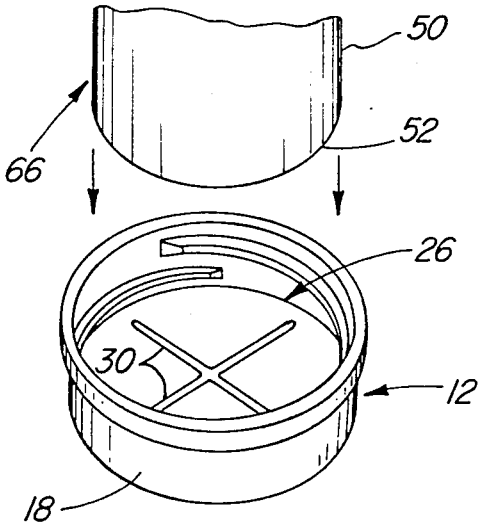
FIG. 9 is a perspective view showing a heated die member which is melted frangible intersecting opening lines in the laminated insert disk within the closure, the die having moved in the direction of the arrows and having been retracted to the position shown.
Figure 10:
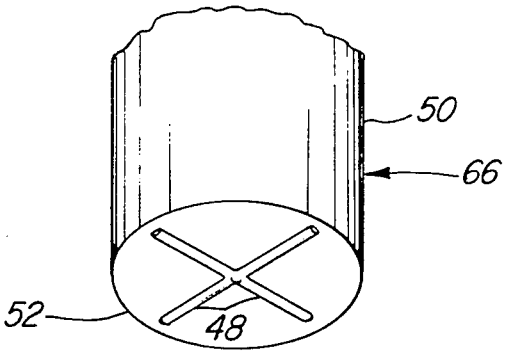
FIG. 10 is a perspective view of the heated die member of FIG. 9 showing the heated tools making an intersecting line opening pattern which also may be one of the multiple die members shown in FIG. 8.

Typically sealing disk 26 is cut from web 34 by a cutting die 50 which, as shown in FIG. 8, may also act to insert the disk into the closure cap 12. In some instances, the cutting and inserting die 50 can also carry the heated tool 48 which as shown in FIGS. 9 and 10 can be in the form of crossed, projecting ridges at the bottom of the die 50. The peripheral end edge 52 of the die member 50 may be raised or sharpened as needed to perform the cutting operation.

The insert sealing disk 26 which has been cut from the laminated web 34 is inserted into cap 12 at cutting and inserting station 54 as shown FIG. 8. A glue is applied at 56 to the open face of the resilient layer 36 for retention of the insert disk 26 in cap 12.

After the containers have been filled with product, and closure 12 is applied to the neck 14 of the container, the finished package is passed through and inductive heating device 58 or similar radiant heat source to fuse the heat sealable coating, bonding the insert disk 26 to the lip 28 of the container neck 14. When the cap 12 is opened, as shown in FIG. 1, the wax layer 38 is fractured leaving the resilient base layer 36 within cap 12 and the thermoplastic film and foil layer fused to container neck.

Figure 3:
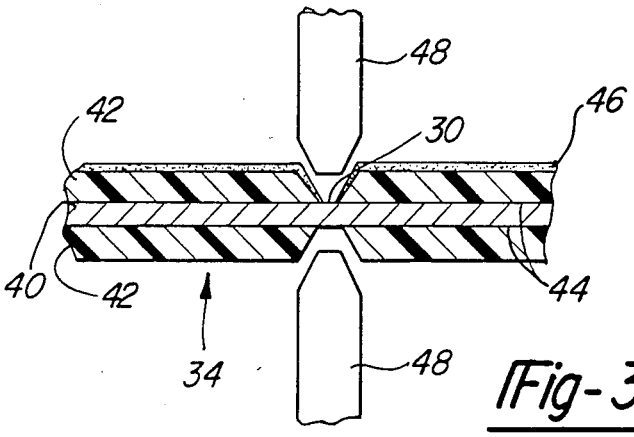
FIG. 3 is a cross-sectional view similar to FIG. 2 showing the cross-section of another laminated liner material having a strengthening thermoplastic film on both sides of the foil and showing the application of a heated melting tool or die to both surfaces to perform the melting step which produces a frangible opening line.
Figure 4:
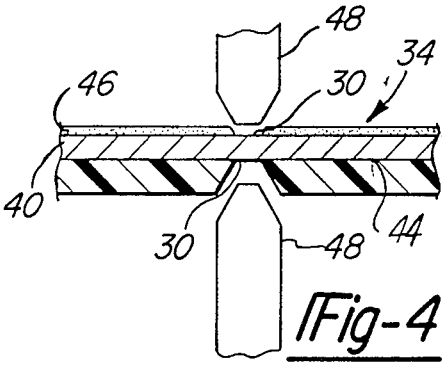
FIG. 4 is a view similar to FIG. 3 showing the cross section of another laminated liner material having a heat sealable coating on one side of the foil and a the thermoplastic strengthening film on the other side of the foil and showing the application of a heated melting tool or die to both surfaces to produce the frangible opening line.

For some applications, it may be desirable to apply a strengthening polyester layer on both sides of the foil. In this case, the frangible opening line will be formed by applying a heated tool 48 to both sides of the laminated web 34 as shown in FIG. 3. In other instances, it may be desirable to fuse the foil layer to the container with the strengthening polyester layer being on the outside without the use of a resilient base layer as shown in FIG. 4. Again, a heated tool 48 would be directed to both sides of the laminated web 34 to form the frangible opening line 30.

As shown in FIG. 8, the frangible opening line 30 may be formed at melting station 60 by melting through the polyester and heat sealing layers on one or both sides of the laminated web 34. Heated melting tool 48 can take the form of rotating disk 62 or stationary blade 64 which can be used simultaneously or alternatively depending upon the laminated structure.

Figure 5:
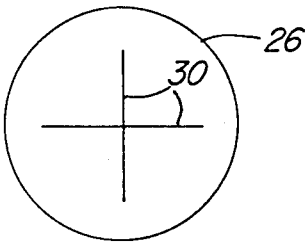
FIG. 5 is a plan view of the laminated sealing disk showing a crossed line pattern for the frangible opening lines.
Figure 6:
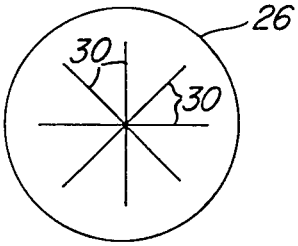
FIG. 6 is a plan view similar to FIG. 5 showing a plurality of intersecting frangible opening lines.
Figure 7:
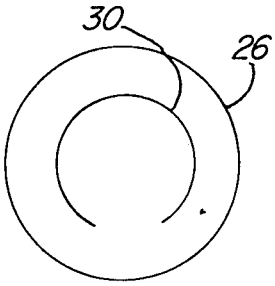
FIG. 7 is a plan view similar to FIGS. 4 and 5 showing a liner disk with a circular frangible opening lines to form a flap type opening.

In the case of forming intersecting frangible line patterns as shown in FIG. 5 or FIG. 6, the heated tools 48 may be located on individual die members 66 on rotating die wheel 68 at alternate melting station 70. In either one of these alternate melting steps, the frangible opening line 30 is formed on the moving laminated web 34 as it is being continuously withdrawn from supply reel 72.

In another embodiment the melted frangible opening line is formed after the laminated disk 26 has been inserted into cap 12. The die members 66 can be part of the cutting die 50 or a separate element depending upon the layout of the particular packaging system.

The embodiments of the invention in which an exclusive property or privilege is claimed are defined as follows:

1. A method for assembling a closure with a sealable liner and applying it to a container to produce a hermetically sealed, easily opened, tamper-indicating package comprising the steps of:

moving a continuous web of a laminated liner comprising a layer of metal foil adhesively bonded to a tough thermoplastic film and a sealing layer;

cutting a linear disk from said web to fit into said closure for sealing to said container;

inserting said liner disk into said closure;

melting through said thermoplastic film to said metal foil layer to form a frangible opening line;

applying said closure to said container; and bonding said liner to said container with said sealing layer, hermetically sealing said container.

2. The method according to claim 1 wherein the sealing layer of said liner is a heat sealable layer, and the step of bonding said liner to said container includes inductively heating said foil to fuse said sealing layer to said container.

3. The method according to claim 1 wherein said laminated liner is formed with one side of said thermoplastic film being bonded to one side of said foil and said heat sealing layer contacting the other side of said thermoplastic film; and said melting step includes melting through said sealing layer and thermoplastic film from one side of said liner to said foil to form said frangible opening line.

4. The method according to claim 3 wherein the laminated liner includes a layer of resilient material having a wax coating layer on one side thereof which is in contact with the other side of said foil layer; and wherein during the step of inserting said liner disk into said closure, said resilient layer is glued to said closure.

5. A method according to claim 1 wherein the step of melting through said thermoplastic layer is performed prior to the step of cutting the liner disk from said web.

6. The method according to claim 5 wherein said melting step is performed by bringing a heated die into contact with said moving web of laminated liner.

7. The method according to claim 9 wherein said heated die forms a plurality of intersecting frangible opening lines.

8. The method according to claim 5 wherein said melting step includes bringing a heated tool in contact with said moving web to form a continuous frangible opening line on one side of said laminated liner.

9. The method according to claim 1 wherein said melting step is performed after said step of inserting the liner disk into said closure by introducing a heated die into said closure into contact with said sealing layer.

10. The method according to claim 9, wherein said heated die melts a pattern of intersecting frangible opening lines in said laminated insert.

11. The method according to claim 1 wherein said cutting, inserting, and melting steps are sequentially performed by a die which cuts said disk from said laminated liner web and pushes said disk into said closure bringing a heated tool surface into contact with said sealing layer to form said frangible opening line.

12. The method of assembling a closure with a heat sealable liner and applying it to a container to produce a hermetically sealed, easily opened, tamper-indicating package comprising the steps of:

moving a continuous web of laminated liner comprising consecutive layers of a resilient material, a wax releasable bond, a metal foil, a tough thermoplastic film and a sealing layer;

cutting a liner disk from said web to fit into said closure;

inserting said liner disk into said closure;

melting through said sealing layer and said thermoplastic film to said metal foil layer to form a frangible opening line;

applying said closure to said container; and heating said foil to fuse said sealing layer to said container whereby access to the contents of said container is obtained by removal of said closure and the exertion of finger force against said liner disk opening said container along said frangible opening line thereby providing indication of tampering or prior opening by the appearance of said liner disk.

13. A method for assembling a closure with a sealable liner and applying it to a container to produce a hermetically sealed, easily opened, tamper-indicating package comprising the steps of:

moving a continuous web of a laminated liner comprising a metal foil with a tough thermoplastic film adhesively bonded to one side thereof and a sealing layer contacting the other side of said foil;

cutting a liner disk from said web to fit into said closure for sealing to said container;

inserting said liner disk into said closure;

melting through said sealing layer on one side of said foil and melting through said thermoplastic film on the other side of said foil to form a frangible opening line;

applying said closure to said container; and bonding said liner to said container with said sealing layer, hermetically sealing said container.

14. A method for assembling a closure with a sealable liner and applying it to a container to produce a hermetically sealed, easily opened, tamper-indicating package comprising the steps of:

moving a continuous web of a laminated liner comprising a layer of metal foil, a first tough thermoplastic film having one side bonded to one side of said foil, a sealing layer on the other side of said first thermoplastic film, a second tough thermoplastic film bonded to the other side of said foil, cutting a liner disk from said web to fit into said closure for sealing to said container;

inserting said liner disk into said closure;

melting through said sealing layer and said first thermoplastic film on one side of said foil and melting through said second thermoplastic film on the other side of said foil to form a frangible opening line, applying said closure to said container; and bonding said liner to said container with said sealing layer, hermetically sealing said container.

15. The method of assembling a closure with a heat sealable liner and applying it to a container to produce a hermetically sealed, easily opened, tamper-indicating package comprising the steps of:

moving a continuous web of laminated liner comprising consecutive layers of a resilient material, a wax releasable bond, a metal foil, a tough thermoplastic film and a sealing layer;

bringing a heated tool into contact with said moving liner web and melting through said sealing layer and said thermoplastic film to said metal foil layer to form a frangible opening line;

cutting a liner disk from said web to fit into said closure;

inserting said liner disk into said closure;

applying said closure to said container; and heating said foil to fuse said sealing layer to said container whereby access to the contents of said container is obtained by removal of said closure and the exertion of finger force against said liner disk opening said container along said frangible opening line thereby providing indication of tampering or prior opening by the appearance of said liner disk.

16. The method of assembling a closure with a heat sealable liner and applying it to a container to produce a hermetically sealed, easily opened, tamper-indicating package comprising the steps of:

moving a continuous web of laminated liner comprising consecutive layers of resilient material, a wax releasable bond, a metal foil, a tough thermoplastic film and a sealing layer;

cutting a liner disk from said web to fit into said closure;

inserting said liner disk into said closure;

introducing a heated die into said closure into contact with said sealing layer and melting through said sealing layer and said thermoplastic film to said metal foil layer to form a frangible opening line;

applying said closure to said container; and heating said foil to fuse said sealing layer to said container whereby access to the contents of said container is obtained by removal of said closure and the exertion of finger force against said liner disk opening said container along said frangible opening line thereby providing indication of tampering or prior opening by the appearance of said liner disk.

* * * * *